United States Patent [19]

Roseland et al.

[11] Patent Number: 4,575,889

[45] Date of Patent: Mar. 18, 1986

[54] APPARATUS FOR LASTING SHOE UPPERS OR SHOES ONTO SHOE LASTS

[75] Inventors: Hermann Roseland, Langwedel-Etelsen; Manfred Bark, Oyten, both of Fed. Rep. of Germany

[73] Assignee: Kloeckner Ferromatik Desma GmbH, Achim, Fed. Rep. of Germany

[21] Appl. No.: 695,282

[22] Filed: Jan. 28, 1985

[30] Foreign Application Priority Data

Jan. 31, 1984 [DE] Fed. Rep. of Germany ..... 3403181

[51] Int. Cl.[4] ..... A43D 3/10; A43D 3/00

[52] U.S. Cl. ..... 12/15; 12/15.1; 12/126

[58] Field of Search ..... 12/15, 15.1, 16, 126, 12/127

[56] References Cited

U.S. PATENT DOCUMENTS

| | | | |
|---|---|---|---|
| 2,062,083 | 11/1936 | Bata | 12/15.1 |
| 2,226,775 | 12/1940 | Lefavour | 12/15.1 |
| 2,421,508 | 6/1947 | Kamborian | 12/15 |
| 2,455,360 | 12/1948 | Farina | 12/15 |
| 2,473,595 | 6/1949 | Lancaster | 12/15.1 |
| 2,621,347 | 12/1952 | Ryan | 12/15.1 |
| 2,708,279 | 5/1955 | McNeill | 12/15 |
| 2,761,158 | 9/1956 | Loewer | 12/15 |
| 3,040,349 | 6/1962 | Levaggi, Jr. | 12/15.1 |
| 4,404,701 | 9/1983 | Hartshorn et al. | 12/127 |

FOREIGN PATENT DOCUMENTS 1685389 3/1975 Fed. Rep. of Germany .

*Primary Examiner*—Werner H. Schroeder
*Assistant Examiner*—Steven N. Meyers
*Attorney, Agent, or Firm*—Watson, Cole, Grindle & Watson

[57] ABSTRACT

An apparatus for the lasting of shoe uppers or shoes onto shoe lasts, and for the removal of the completed shoes from the shoe lasts, includes a two-part shoe last having a front toe part and a heel part, a fixing device for removably mounting the front toe part on the frame, and a coupling device for movably and releasably mounting the heel part of the frame, the coupling and-/or fixing device including pivotable clamping bars, and a height-adjustable mechanism for moving the heel part and its coupling from a rest position toward the front toe part, and back to such rest position.

16 Claims, 12 Drawing Figures

APPARATUS FOR LASTING SHOE UPPERS OR SHOES ONTO SHOE LASTS

BACKGROUND OF THE INVENTION

This invention relates to an apparatus for the lasting of shoe uppers and/or shoes onto shoe lasts, especially shoes to be repaired, and for removing completed shoes from the lasts.

In the production of shoes, soles of polyurethane, thermoplasts, Nylon, etc. material are injection molded in place employing a shoe-soling machine having several work stations. Before applying the soles, the shoe or boot uppers are pulled onto the shoe lasts, so that, together with extrusion molds, the material is injection molded for applying the soles. Generally, the work stations include height-adjustable rotatable heads at which the lasts carrying the shoe uppers are arranged in pairs, so that, during the operation at the work station, a sole can be applied to one shoe upper, while simultaneously a completed shoe or boot can be removed from the last at a different, mold-opening work station.

Also, glue presses may be employed for gluing soles onto the lasted shoe uppers. Such is the normal method for soling worn shoes.

Initially, the shoe material is normally formed into shoe uppers by placing the material onto clamping lasts away from the shoe soling work station. In many cases, the formed shoe uppers are removed from the lasts and are thereafter pulled onto the metal lasts at the shoe soling machine.

It is also known to injection mold the soles directly onto the shoe uppers formed on the clamping lasts at the shoe forming station. Thus, the clamping lasts are removably mounted on last holders. Such last holders, being separate parts, provide the connection with the rotatable heads. These shoe lasts may therefore be formed similar to that of a shoe last on which the shoe upper itself is formed. In general, these clamping lasts are so arranged as to be of a somewhat higher elevation than that of the shoe upper so that, after the lasting of the shoe upper, the last can be connected with the last holder without difficulty. Otherwise, if the shoe uppers are elevated relative to the lasts, the height difference can, in certain circumstances, be equalized by suitable spacers. The forming of a shoe or boot upper on a last which is thereafter pulled onto a metal last for shoe soling, or the lasting on a clamping last at the shoe upper forming station, always proceeds in such a manner that the shoe leather or other material, which has previously been dampened, is formed on the last or clamping last, and thereafter when removed to the metal last, the sole is applied, and the finished shoe is passed through a heating station so that it retains its requisite shape after removal from the last.

Basically, the same problems arise during lasting, changing of lasts and removal from lasts, if the last or clamping last is formed of a single piece, such that the shoe material will be stretched during lasting, while changing lasts or during removal from the last. During such operation, the shoe material could permanently deform thereby changing the intended shoe size. Basically, this problem is avoided by providing lasts or clamping lasts of two parts so that, during lasting, changing of lasts or removal from the last by means of a relative movement of these two parts toward one another, the movement of the foot (as when normally putting on or removing a shoe) can essentially be reproduced so as to avoid wrenching the shoe.

German Pat. No. 16 85 389 generally discloses a two-part last comprising a heel part and a front toe part which basically serves the purpose of permitting boots to be lasted or removed from the lasts without affecting the shoe size during formation of the shoe uppers.

Similar problems are prevelant during a shoe repair operation, especially when gluing on new shoe soles. Heretofore, single part lasts have always been employed for original soling or repairing of even customized shoes in shoe repair shops, etc. However, the shoes are often widened by the use of such single part lasts as when they are pulled tightly onto the last. This is also true during the production of shoes or boots when the soles are glued on.

Despite the advantages obtained with the use of two-part lasts and/or clamping lasts, it is recognized that dealing with these two-part lasts is cumbersome, and that to some extent continued stretching of the shoe material cannot be entirely avoided.

SUMMARY OF THE INVENTION

It is therefore an object of the present invention to provide an apparatus having a two-part last for the production of exact-size shoes, and/or to retain the fitting shoe size. The apparatus provides for the lasting of shoe uppers or shoes onto clamping last or lasts, particularly shoes to be repaired, which ensures that the fitting size of the shoes or boots is not adversely affected completed shoes therefrom without affecting the shoe size during lasting, removal from the last or changing lasts (changing lasts is intended to mean lasting, removal from the last and lasting onto another last for the purpose of applying a sole).

In accordance with the invention, such apparatus has a two-part last which comprises a front toe part and a heel part, a fixing device for removably mounting the front part on the frame of the apparatus in its intended position, and a pivotable and height-adjustable coupling device for the heel part, such that during lasting and/or removal from the last, the fixing device fixes the front part in its position, and the coupling device moves the heel part from its at rest position toward the front part. The essential factor of the invention is that the heel part is essentially moved toward the front part in such a manner that the movement of the foot is reproduced as when putting on or removing a shoe, the pivotable and height-adjustable coupling device being arranged to effect a simple yet highly effective movement. Moreover, movement of the heel part must be so limited so as to avoid any excessive stretching of the shoe material due to undue pivoting or height adjustment of the heel part. It should be pointed out that the rest position of the heel part is defined by a position of the heel part and the front part as in the manner of a single part last.

The two-part last according to the invention is such that the heel and toe parts can be separated from one another, and have complementary meeting surfaces in contact engagement in the rest position of the last and during movement of the heel part for inserting same into the heel portion of the shoe upper on the last.

The fixing device has a centering pin which extends into a centering hole in the front part of the last, the centering pin being adjustable in a direction along the last axis so as to accommodate the centering holes of differently sized front parts.

In one embodiment according to the invention, the centering pin can be positively locked to the front part via a mounting plate on the front part having a bayonette slot, so that the front part is immovable even when exerting a strong force thereagainst during movement of the heel part.

The coupling device for the heel part, which is likewise available as a fixing device for the front part, includes a pair of pivotable clamping bars having clamping jaws in engagement with the base of the heel part when projecting into recesses provided in the heel part for retaining the heel part in its rest position. A pivotable operating lever is provided for pivoting the clamping jaws open to permit replacement of the heel part.

Other objects, advantages and novel features of the invention will become more apparent from the following detailed description of the invention when taken in conjunction with the accompanying drawings.

DETAILED DESCRIPTION OF THE INVENTION

Figure 1:
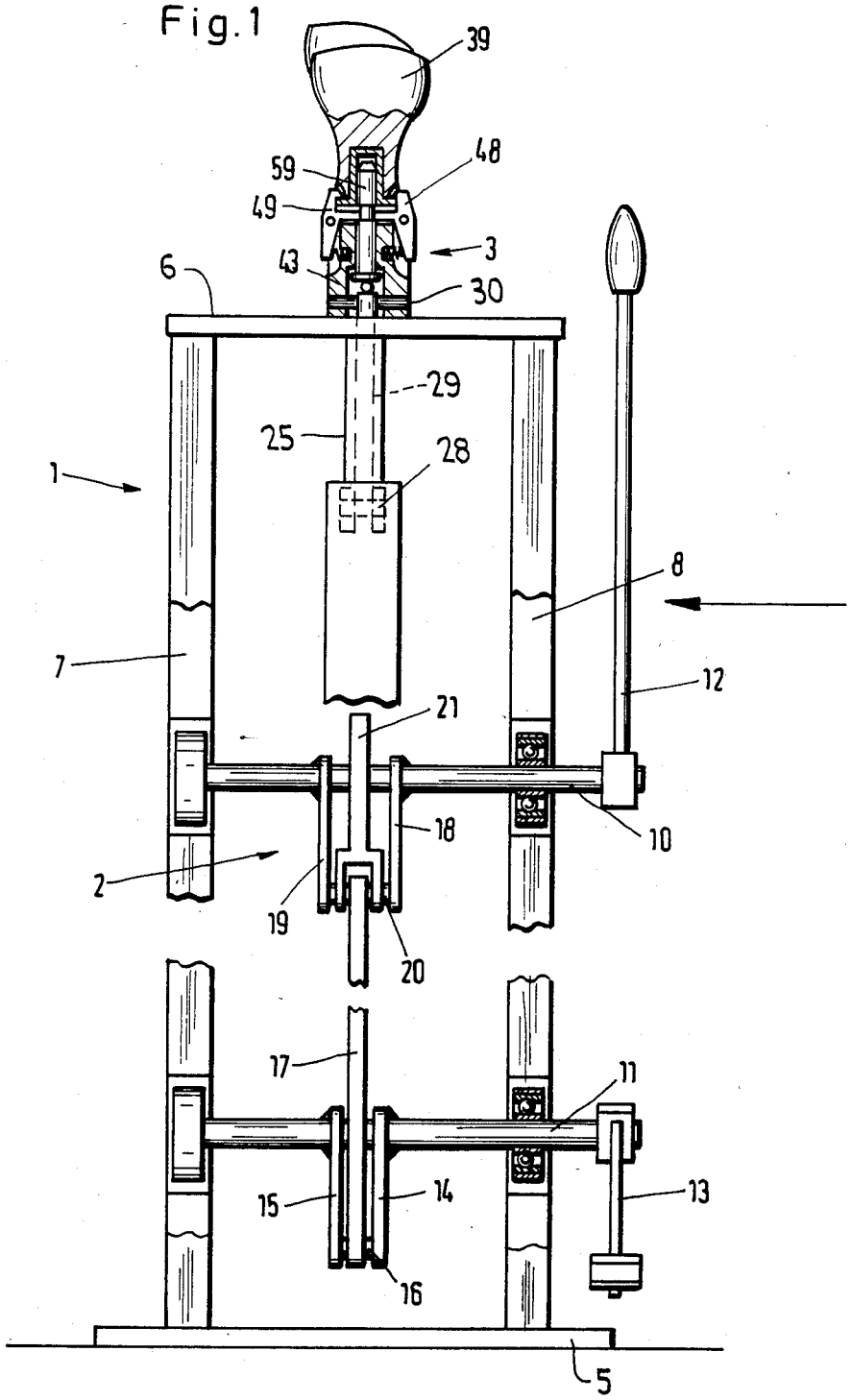
FIG. 1 is a front elevational view of one embodiment of the apparatus according to the invention, in a direction facing the operator.
Figure 2:
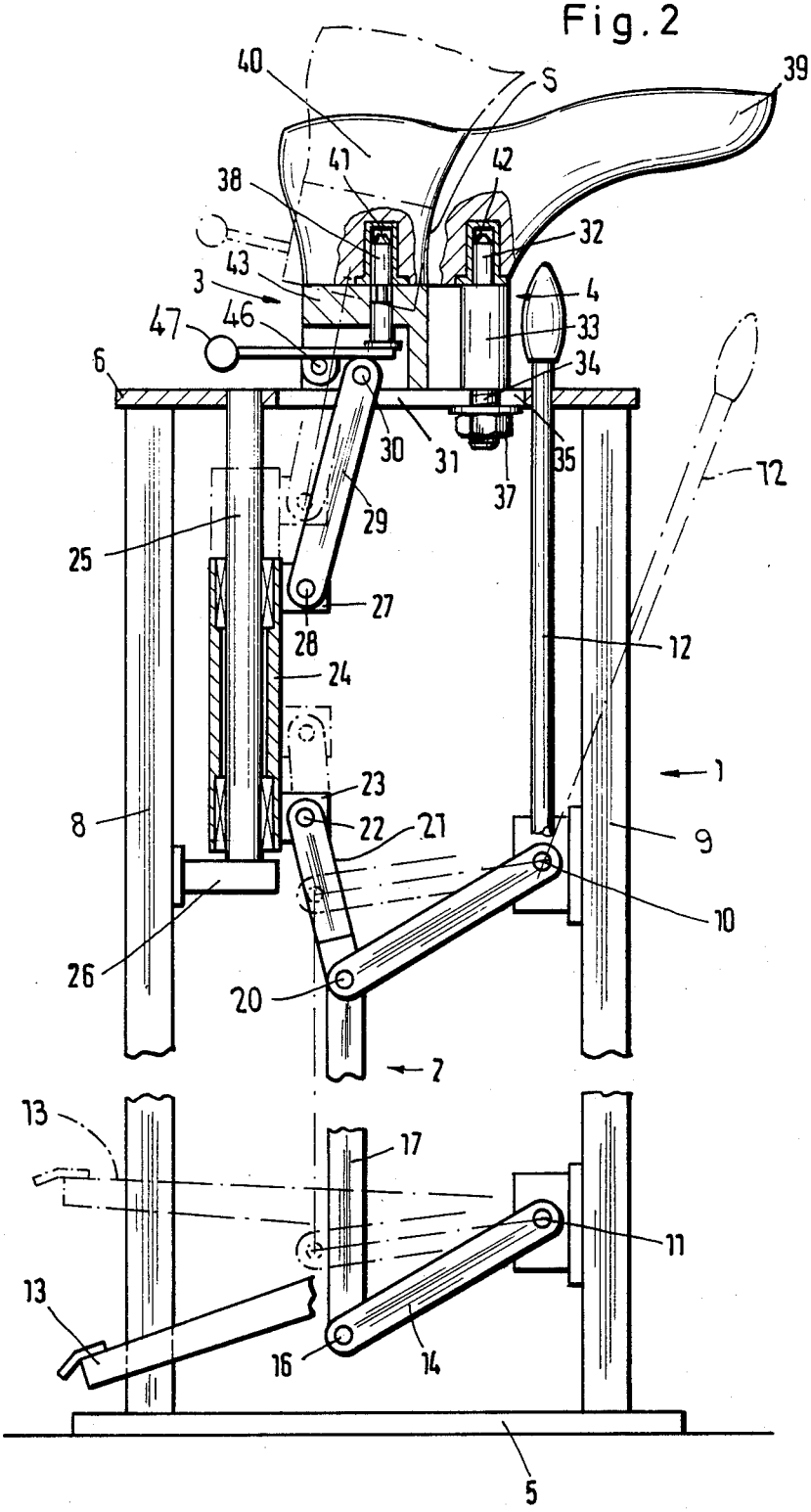
FIG. 2 is a side elevational view taken in the direction of the bold arrow of FIG. 1, showing the coupling device and fixing device on the apparatus.

Turning now to the drawings wherein like reference characters refer to like and corresponding parts throughout the several views, the apparatus according to one embodiment of the invention is illustrated in FIGS. 1 and 2 as comprising a frame 1 having a linkage assembly generally designated 2 mounted thereon, a height-adjustable coupling device generally designated 3, and a fixing device generally designated 4.

The apparatus frame comprises a base plate 5 and an upper support plate 6, a pair of upright square support posts 7 and 8 at the front end, and a pair of like support posts 9 at the rear end (only one of which is visible in FIG. 2). Side walls (not shown) may be used to cover the support posts in a box-like fashion.

Transversely extending, upper and lower axle rods 10 and 11 are mounted on front support posts 7 and 8 via suitable bearings for rotation about their central axes, a handle 12 being fixedly mounted on one end of bar 10, and a foot pedal 13 being fixedly mounted on one end of bar 11. A pair of spaced flat link bars 14 and 15 are fixedly mounted on rod 11 and are interconnected at the free end thereof by a pivot pin 16. A flat link bar 17 is pivotally connected at one end to pin 16 and at its other end to a pivot pin 20 which interconnects the free ends of a pair of spaced, flat link bars 18 and 19 fixedly mounted on upper rod 10. The forked end of a flat link bar 21 is likewise pivotally connected to pin 20, with its other end pivotally mounted on a pivot pin 22 which spans a pair of lug plates 23 (only one shown in FIG. 2) mounted on a vertically slidable sleeve 24. This sleeve surrounds a guide shaft 25 fixedly mounted to the frame at one end by means of a support plate 26 and at its other end to top plate 6. A pair of spaced lug plates (only one shown in FIG. 2) is mounted to the upper end of sleeve 24, a pivot pin 28 spans these lug plates, and a flat link bar 29 is pivotally connected at one end to pin 28. A transverse pivot pin 30 is secured to coupling device 3, and link bar 29 is pivotally connected thereto at its other end.

Upper plate 6 has an elongated slot 31 through which link bar 29 extends when in its lowered position shown in solid outline in FIG. 2, and in its raised position shown in phantom outline in FIG. 2. With such a linkage arrangement, it can be seen that movement by the operator of handle 12 to its phantom outline position in FIG. 2, will function to raise sleeve 24 to correspondingly raise the coupling device to its phantom outline position above upper plate 6, and movement of the coupling device back to its rest position on plate 6 is effected by the operator upon movement of either handle 12 from its phantom outline to its solid outline position, or by a depression of the foot pedal from its phantom outline to its solid outline position.

Fixing device 4, as shown in FIG. 2, comprises a centering pin 32 extending outwardly of cylinder 33 which rests on upper plate 6 a threaded shaft 34 on the cylinder extends through an elongated slot 35 in plate 6, and the fixing device is mounted on plate 6 by means of a washer 36 and a nut 37. Elongated slot 35 permits the fixing device to be adjusted along the central axis of the shoe last to accommodate differently sized front parts of the shoe last.

As shown in FIG. 2, coupling device 3 likewise includes a centering pin 38 formed at the end of an axially movable rod guide by the coupling device.

The two-part last shown in FIG. 2 comprises a front toe part 39 and a heel part 40, the heel part having a centering hole 41 formed therein and the front part having a centering hole 42 formed therein which respectively receive centering pins 38 and 32. The relative positioning of the heel and front parts is therefore defined by the centering pins, and pin 32 is capable of being set to accommodate differently sized front parts. The heel and front parts of the last each have a complementary mating surfaces S at which the parts mate in the at rest position shown in solid outline in FIG. 2. And, as will be described, heel part 40 and its coupling device are elevated during the lasting operation to the phantom outline position as the mating surface of heel part 40 slides along the mating surface of the front part of the shoe last.

The coupling device shown in FIG. 2 includes an operating handle 47 mounted between its ends on a pivot pin 46 affixed to a support block 43 of the coupling device for operating a pair of pivotable clamping bars 48 and 49 shown in FIG. 1.

Figure 3:
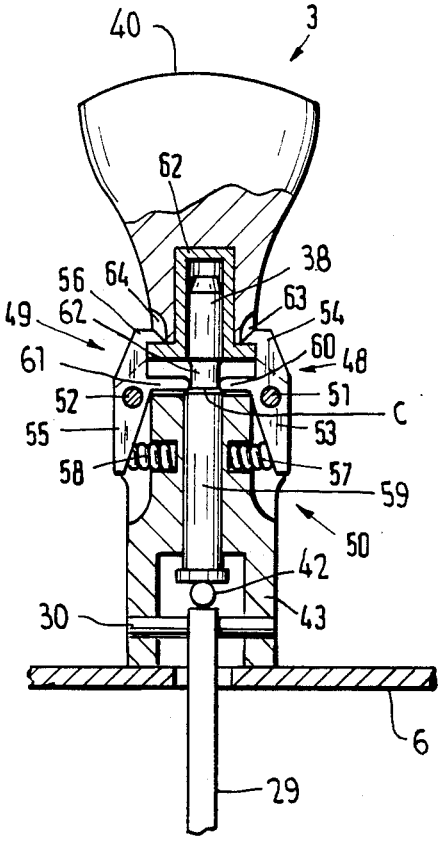
FIG. 3 is an enlarged sectional view of the coupling device of FIG. 1.

This pivotable and height-adjustable coupling device is shown in slightly enlarged detail in FIG. 3 as comprising a cylindrical segment 50 integral with block 43, the clamping bars 48 and 49 being pivotably connected to segment 50 on pivot pins 51 and 52 between opposite ends of the bars which thus operate each as a two-armed lever. Bar 48 has a lower arm 53 and an upper arm 54 forming an inwardly directed clamping jaw, and bar 49 has a lower arm 55 and an upper arm 56 forming an inwardly directed clamping jaw. Springs 57 and 58 are seated within suitable bores provided in segment 50 and abut against arms 53 and 55 for maintaining the clamping jaws biased inwardly toward rod 59 on which centering pin 38 is formed, the rod being axially movable in segment 50. The clamping bars include inwardly directed cams 60 and 61 which extend into an annular groove 62 formed on the rod, this groove forming a sloping cam surface C at the lower transition with the rod diameter. In the at rest position of FIG. 3, this cam surface lies just below cam elements 60 and 61. And, a centering hole liner 62 is frictionally fit within centering hole 41 of heel part 40, this liner having an annular flange at its lower end. The outer surface of this flange is coplanar with the bottom surface of the heel part which rests against the upper surface of support block 43. At the opposite side of this annular flange, opposing sides of the heel part has recesses 63 and 64 into which the jaws of the clamping bars extend for coupling the heel part to support block 43 in the at rest position shown in FIG. 3. Thus, to release the heel part from block 43, the outer end of handle 47 is simply depressed so as to pivot same about pin 46 for thereby raising bar 59 and causing the clamping jaws at ends 54 and 56 of the clamping bars to pivot outwardly out of engagement with the flange of liner 62 as cam elements 60 and 61 progressively slide along cam surface C of the rod. The clamping jaws are thus moved outwardly against the force of springs 57 and 58.

Figure 4:
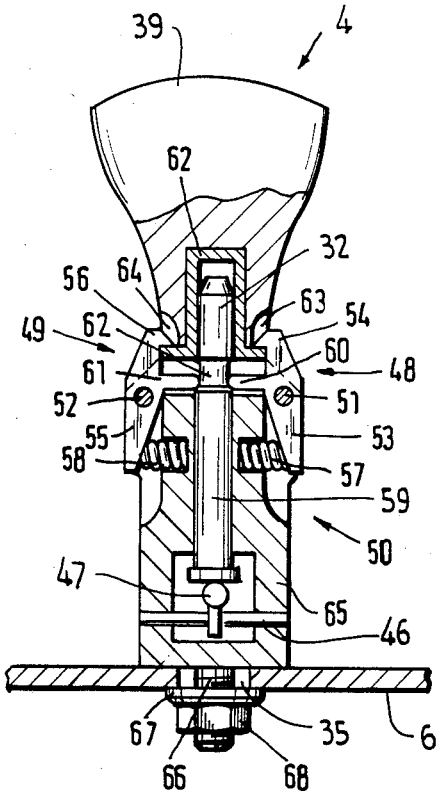
FIG. 4 is a view similar to FIG. 3 of a fixing device for the front toe part of the last, which is similar to the coupling device of FIG. 3.

In lieu of the fixing device for the front toe part 39 of the two-part last as shown in FIG. 2, a fixing device is shown in FIG. 4 for this front part which essentially corresponds to coupling device 3 shown in FIG. 3 as provided for heel part 40. Thus, the same parts in FIG. 4 will be identified by the same reference numerals. However, instead of support block 43, a support block 65 is provided as adjustably mounted on support plate 6, a threaded bolt 66 extending from block 65 through elongated opening 35 in plate 6, for thereby mounting block 65 thereto by means of a washer 67 and a nut 68. As in the fixing device described with reference to FIG. 2, the FIG. 4 fixing device is capable of adjustment in the direction of the central axis of the last, to accommodate differently sized front parts. Otherwise, front toe part 39 of the two-part last is releasably coupled to support block 65 in the same manner as that described in FIG. 3.

For lasting a shoe upper or a shoe, the two-part clamping last is set in place on the apparatus such that centering pin 32 extends into centering hole 42 of the front toe part, and centering pin 38 extends into the centering hole 41 of the heel part. The downwardly and inwardly sloping upper surfaces of the clamping jaws permit the heel part to be snapped into place in the FIG. 3 position, or handle 47 may be simply depressed to raise rod 59 for centering the heel part over the centering pin after which the heel part is positioned in place over the support block into the position shown in FIG. 3. Likewise, if a fixing device such as that shown in FIG. 4 is provided for the front toe part 39, it is coupled in place as similarly described for the heel part. Thereafter, the shoe or shoe upper is placed on the front toe part of the two-part last and, by pulling on handle 12 to its phantom outline position of FIG. 2, coupling device 3 is raised to its phantom outline position together with heel part 40 and moves slightly forwardly toward the front toe part as shown. When the heel part is raised, it extends into the heel portion of the shoe upper or shoe such that this heel portion moves in the direction of the toe portion of the shoe or shoe upper. Foot pedal 13 is then depressed from its phantom outline to its solid outline position of FIG. 2 so that the heel portion of the shoe upper or shoe assumes its fully extended position over the shoe last, as the coupling device and the connected heel part 40 are lowered back to the position at rest shown in FIG. 2.

Figure 5A:
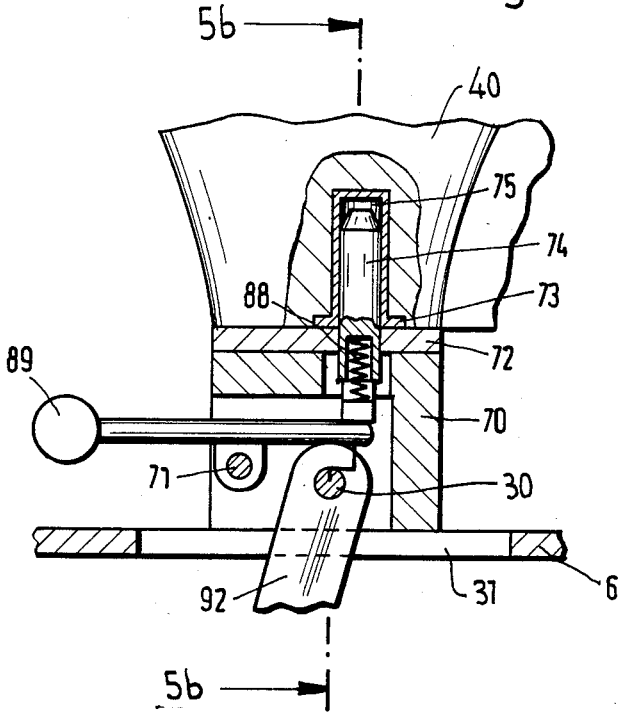
FIG. 5*a* is a sectional view of another coupling device for the heel part of the last.
Figure 5B:
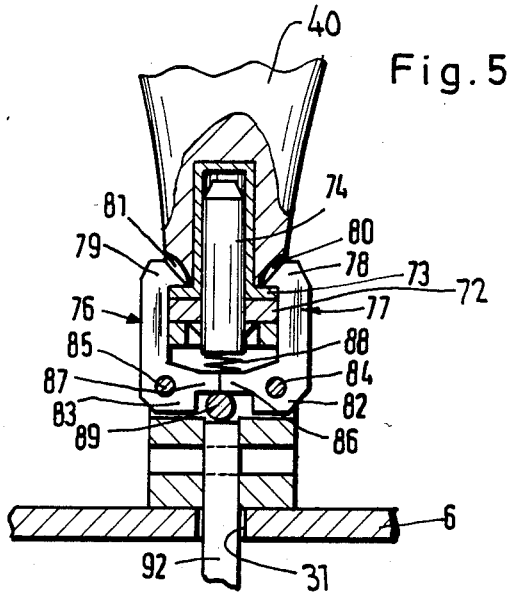
FIG. 5*b* is a sectional view taken substantially along the line 5*b*—5*b* of FIG. 5*a;*

FIGS. 5*a* and 5*b* show another coupling device arrangement for the heel part of the two part last. A support block 70 thereof rests on support plate 6, and the upper end of flat link bar 29 extends into a hollow opening of the support block through elongated slot 31 and is pivotally connected to pin 30 similarly as in FIG. 2. An impact plate 72 is fixed to the top side of block 70 and has a hole coaxial with recess 41 through which rod 74 extends, recess 41 being lined by a hollow liner having an annular flange 73, similarly as described with reference to FIG. 3. For coupling the heel part, a pair of substantially U-shaped coupling bars 76 and 77 having clamping jaws 78 and 79 formed at the upper ends thereof extend into recesses 80 and 81 formed at the base of the heel part for engagement behind flange 73. The clamping bars are mounted at their lower ends 82 and 83 to block 70 for pivotal movement about pins 84 and 85 located a distance below impact plate 72. And, segments 86 and 87 extend from the clamping bars and are in contact engagement above operating handle 89 which is pivotally mounted to block 70 via pin 71. A coil spring 88 is disposed between segments 86, 87 and the lower end of rod 74. In this embodiment, rod 74 is affixed to impact plate 72, as shown. Thus, upon depressing handle 89 against the force of spring 88, segments 86, 87 are caused to upwardly pivot about pins 84 and 85 to thereby move clamping jaws 78 and 79 outwardly out of engagement with flange 73, for thereby uncoupling the heel part of the two-part last.

Figure 6A:
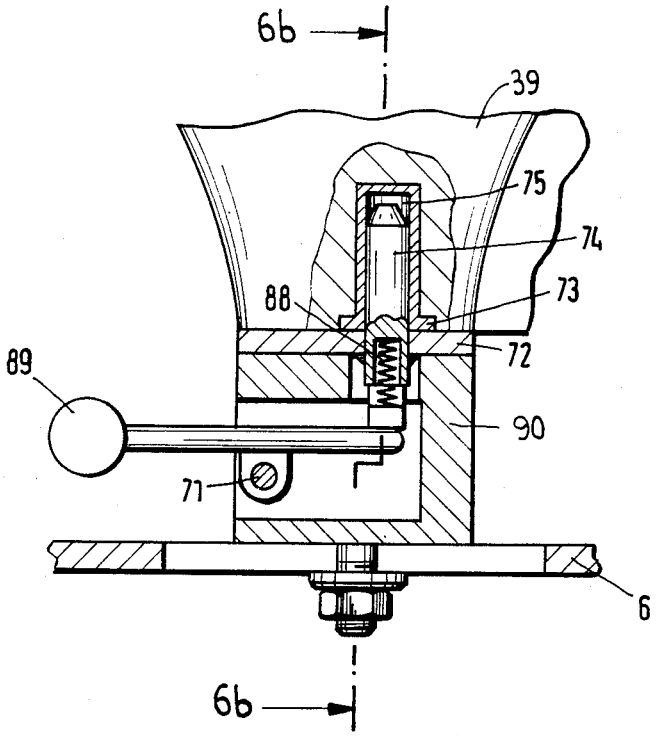
FIG. 6*a* is a view similar to FIG. 5*a* of an alternate fixing device for the front part of the last.
Figure 6B:
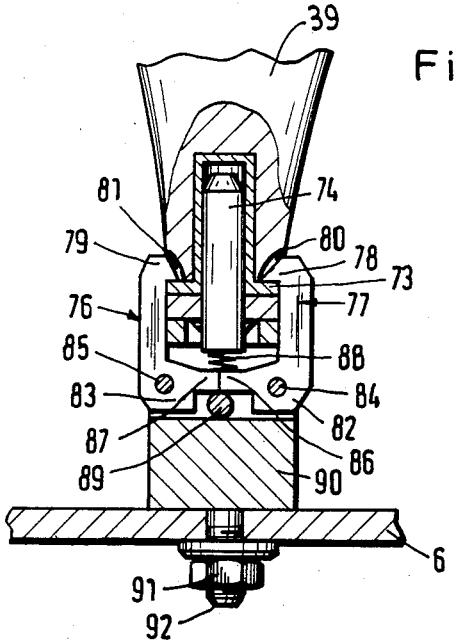
FIG. 6*b* is a sectional view taken substantially along the line 6*b*—6*b* of FIG. 6*a;*

Front toe part 39 of the two-part last may likewise be coupled and uncoupled in place by a similar coupling device shown in FIGS. 5*a*, 5*b* except that a threaded shank 92 and a nut 91 are provided as shown in FIGS. 6*a*, 6*b* for adjustably mounting the fixing device in place. Otherwise, the coupling device of FIGS. 6*a*, 6*b* operates the same as that of FIGS. 5*a*, 5*b*.

Figure 7:
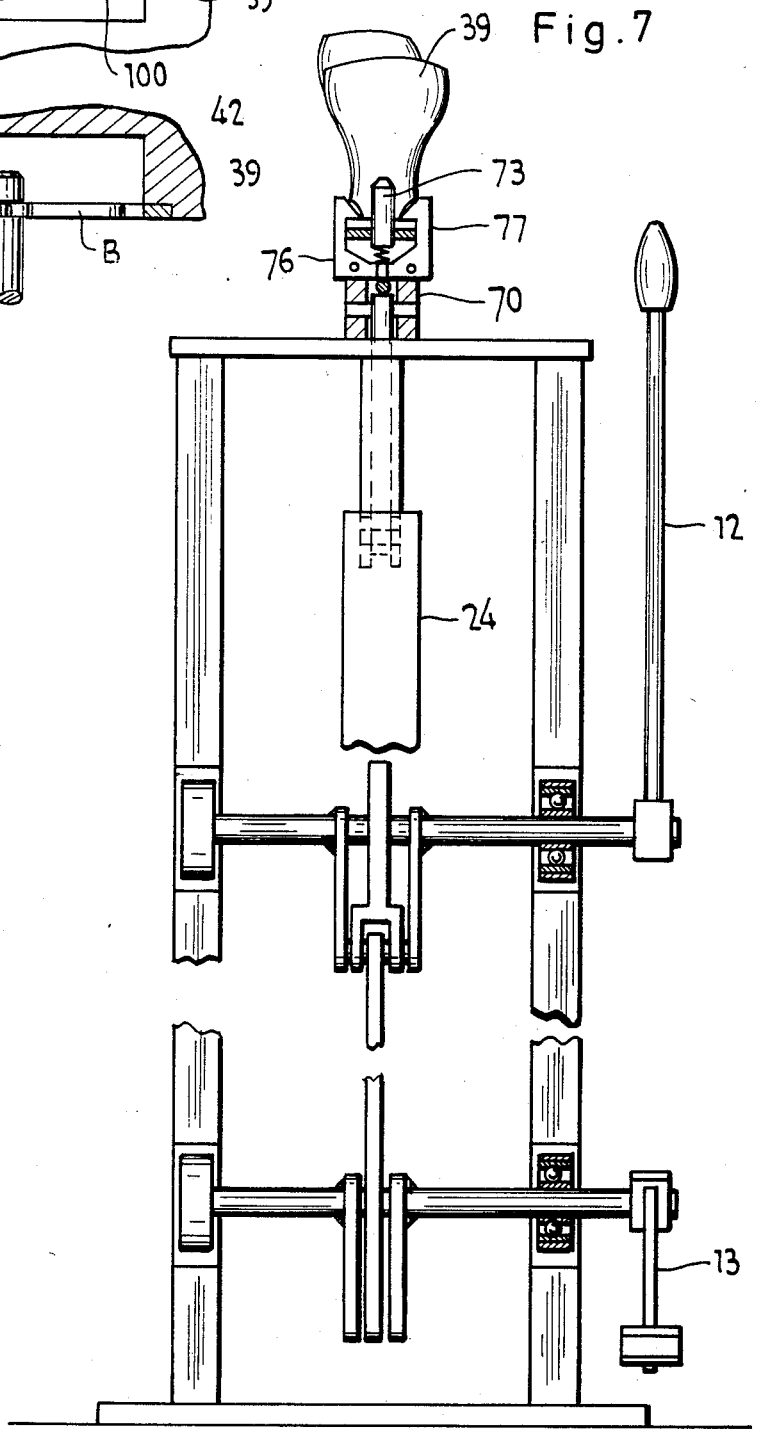
FIGS. 7 and 8 are views respectively similar to FIGS. 1 and 2 incorporating the heel part coupling device of FIG. 5.
Figure 8:
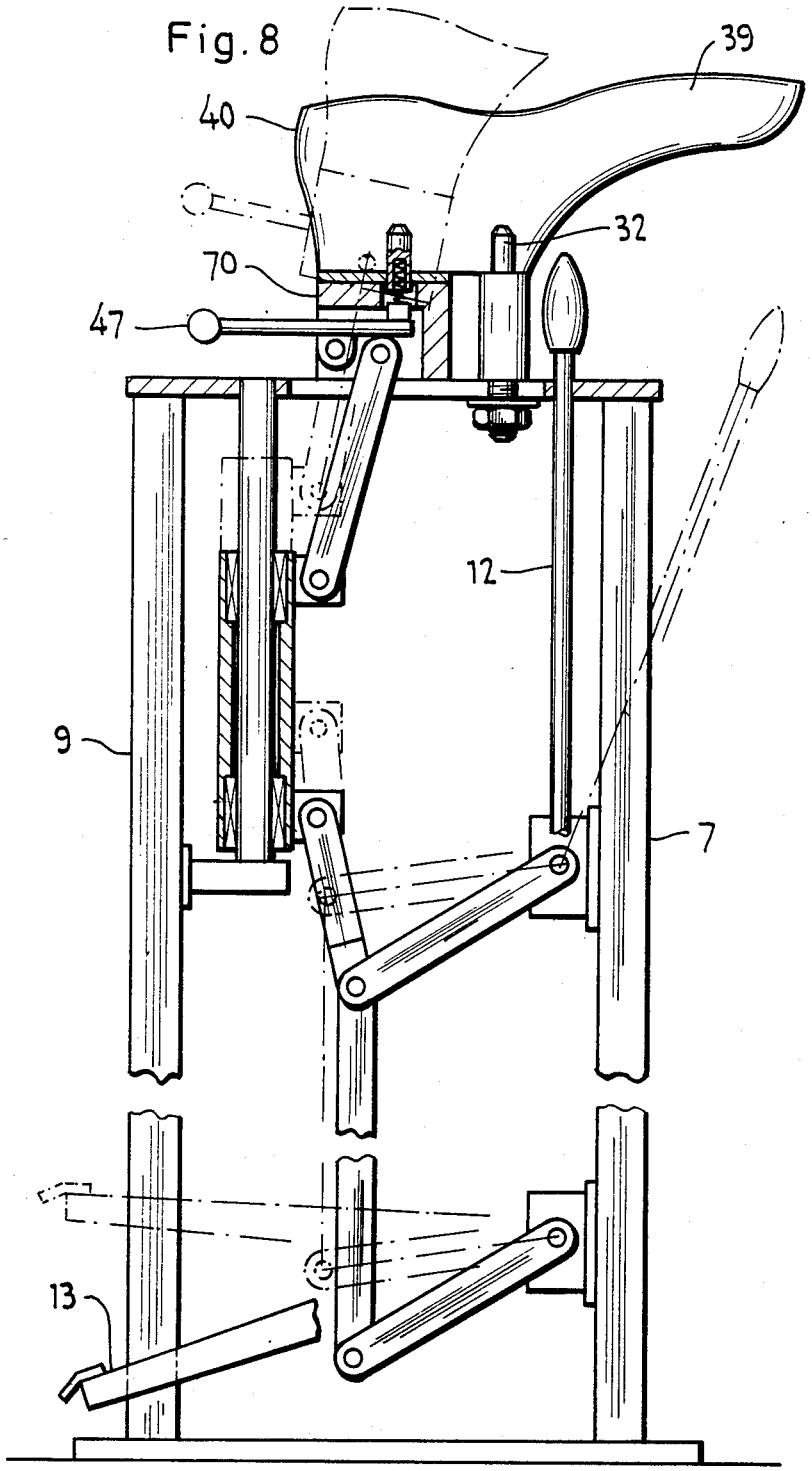

FIGS. 7 and 8 illustrate an apparatus similar to that of FIGS. 1 and 2 except that the apparatus includes a coupling device according to FIGS. 5*a*, 5*b*. Otherwise, the support block and the heel part of the two-part last coupled thereto are elevated relative to the front toe part in the same manner as that described with reference to FIGS. 1 and 2.

Figure 9:
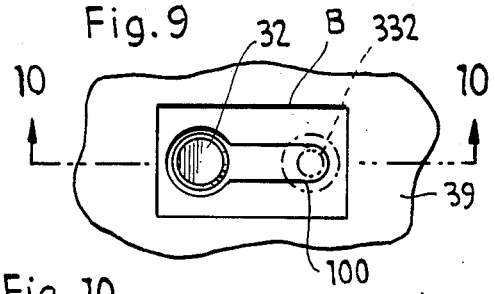
FIG. 9 is a plan view of the underside of the front part having a bayonette-type mounting plate.
Figure 10:
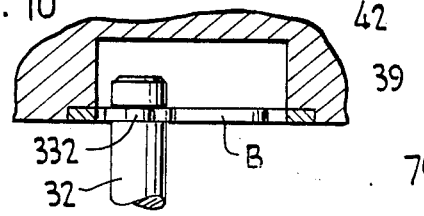
FIG. 10 is a sectional view taken substantially along the line 10—10 of FIG. 9.

The fixing device for front part 39 can alternatively include a plate B which covers an enlarged centering hole 32 and has a bayonette slot 100 as shown in FIGS. 9 and 10. Centering pin 32 is thus modified to include an annular groove 332, such that during mounting pin 32 extends through the circular opening of slot 100 and groove 332 permits the pin to engage the elongated opening of slot 100 as in a typical manner for fixing the front part of the last in place on the centering pin.

From the foregoing, it can be seen that front and toe parts of differently sized two-part lasts are capable of being quickly and easily mounted in place with the use of the coupling devices and/or fixing devices described. When the heel and toe parts are positioned over their centering pins, the fixing device can be adjusted relative to the coupling device so that the mating surfaces between the two parts are in engagement, as required. The coupling device and a fixing device version are operated by a handle which simply moves a pair of clamping bars apart to facilitate the removal and/or substitution of other heel parts or toe parts when required. And, the apparatus includes a height adjustment mechanism in which the heel part coupling device and the coupled heel part are raised relative to the front part of the two-part last and moved in a slightly forward direction so that, after the shoe upper or shoe is applied to the toe part, the heel part extends into the heel portion of the shoe upper or shoe, whereafter the heel part is lowered to its at rest position to thereby snugly embrace the shoe upper or shoe. Besides, when the heel part is extended into the heel portion, movement of the foot is essentially reproduced, as when putting on or removing a shoe from the person's foot, which is desirable since it does not involve any shoe wrenching and produces a normal heel/toe movement. And, when lasting a shoe or boot, the linkage arrangement provided for the apparatus permits the operator to complete the lasting operation using a foot pedal thereby leaving both hands free to feel whether the lasting on the last is in accordance with requirements, while removal from the last can proceed rapidly and safely by manual operation of the handle.

Many other modifications and variations are made possible in the light of the above teachings. It is therefore to be understood that within the scope of the appended claims the invention may be practiced otherwise than as specifically described.

What is claimed is:

1. An apparatus for the lasting of shoe uppers and shoes onto shoe lasts, and for the removal of the completed shoes from the shoe lasts, comprising a frame, a least one two-part shoe last on an upper surface of said frame, said shoe last comprising a front toe part and a heel part, a fixing device for removably mounting said front toe part on said frame, and a coupling device for movably and releasably mounting said heel part on said frame, said coupling device including pivotable means for releasably mounting said heel part, and height-adjustable means for moving said heel part from a rest position upwardly away from said frame and toward said front toe part, and back to said rest position.

2. The apparatus according to claim 1, wherein said fixing device comprises a centering pin mounted on said frame, said front toe part having a centering hole in a surface thereof confronting said fixing device, said pin extending into said hole for retaining said front toe port in place.

3. The apparatus according to claim 2, wherein said pin is in frictional engagement with the wall of said hole.

4. The apparatus according to claim 2, wherein a plate having a bayonette opening covers said hole, said pin having an annular groove to facilitate a bayonette engagement between said pin and said plate.

5. The apparatus according to claim 1, wherein said front part has a pair of opposed recesses and a centering hole in a surface thereof, said fixing device comprises a pair of opposed, pivotable clamping bars having jaws extending into said recesses for normally coupling said front part, an axially movable rod extending into said hole, said rod engaging said bars for pivoting same out of engagement with said front part upon movement of said rod, and a pivotable operating handle for axially moving said rod.

6. The apparatus according to claim 5, wherein each said clamping bar has a pair of oppositely extending arms, and each said bars mounted for pivotal movement between the ends of said arms.

7. The apparatus according to claim 6, wherein said rod has a sloping annular cam surface, and said clamping bars have cam elements engageable with said cam surface for pivoting said bars out of engagement with said front part upon the movement of said rod.

8. The apparatus according to claim 5, wherein a hole liner is fixed within the hole of said front part, said liner having a flange exposed by said recesses and engaged by said jaws of said bars.

9. The apparatus according to claim 6, wherein said jaws are located on an upper one of said arms, and spring means bear against the lower ones of said arms for resiliently urging said jaws into engagement with said front part.

10. The apparatus according to claim 1, wherein said heel part has a pair of opposed recesses and a centering hole in a surface thereof, said coupling device comprises a pair of opposed, pivotable clamping bars having jaws extending into said opposed recesses for normally coupling said heel part, an axially movable rod extending into said hole, said rod engaging said bars for pivoting same out of engagement with said heel part upon movement of said rod, and a pivotable operating handle for axially moving said rod.

11. The apparatus according to claim 10, wherein each said clamping bar has a pair of oppositely extending arms and being pivotably mounted for pivotal movement between the ends of said arms, said jaws being located on an upper one of said arms, spring means bearing against the lower ones of said arms for resiliently urging said jaws into engagment with said heel part, and said bars having cam elements engageable with said rod to effect the pivoting of said bars out of engagement with said heel part upon the movement of said rod.

12. The apparatus according to claim 11, wherein said rod has a sloping annular cam surface with which said cam elements engage to effect said pivoting of said bars.

13. The apparatus according to claim 10, wherein a hole liner is fixed within the hole of said heel part, said liner having a flange exposed by said recesses and engaged by said jaws.

14. The apparatus according to claim 1, wherein said fixing device includes an impact plate, said front part having a pair of opposed recesses, a centering hole extending through said plate and said front part, a pair of pivotable clamping bars having jaws extending into said recesses for normally engaging said front part, an axially movable rod extending into said hole for positioning said front part, said bars being mounted for pivotable movement at lower ends thereof below said plate, said bars having lower end segments extending toward one another, spring means located above said end segments and below said rod, and a pivotally mounted handle having one end in engagement with lower surfaces of said end segments for thereby pivoting said bars out of engagement with said front part upon pivoting movement of said handle.

15. The apparatus according to claim 1, wherein said coupling device includes an impact plate, said heel part having a pair of opposed recesses, a centering hole extending through said plate and said front part, said means for releasably mounting said heel part comprising a pair of pivotable clamping bars having jaws extending into said recesses for normally engaging said heel part, an axially movable rod extending into said hole for positioning said heel part, said bars being mounted for pivotable movement at lower ends thereof below said plate, said bars having lower end segments extending toward one another, spring means located above said end segments and below said rod, and a pivotably mounted handle having one end in engagement with lower surfaces of said end segments for thereby pivoting said bars out of engagement with said heel part upon pivoting movement of said handle.

16. The apparatus according to claim 1, wherein said height-adjustable means comprises an upstanding guide shaft fixed to said frame, a sleeve slideable on said shaft, a link arm pivotally mounted at one end to said sleeve and pivotally mounted at its other end to said coupling device, and a linkage assembly pivotally interconnecting said sleeve with said frame, an arm lever and a foot lever operatively connected with said assembly for optionally sliding said sleeve for thereby elevating and lowering said coupling device.

* * * * *